US010059105B2

(12) United States Patent
Yao

(10) Patent No.: US 10,059,105 B2
(45) Date of Patent: Aug. 28, 2018

(54) MECHANISM FOR SEAMLESSLY SPLICING NOZZLES

(71) Applicants: Peking University Founder Group Co., Ltd., Beijing (CN); Beijing Founder Electronics Co., Ltd., Beijing (CN)

(72) Inventor: Yunhui Yao, Beijing (CN)

(73) Assignees: PEKING UNIVERSITY FOUNDER GROUP CO., LTD., Beijing (CN); BEIJING FOUNDER ELECTRONICS CO., LTD., Beijing (CN)

( * ) Notice: Subject to any disclaimer, the term of this patent is extended or adjusted under 35 U.S.C. 154(b) by 217 days.

(21) Appl. No.: 14/778,382

(22) PCT Filed: Dec. 4, 2013

(86) PCT No.: PCT/CN2013/088484
§ 371 (c)(1),
(2) Date: Sep. 18, 2015

(87) PCT Pub. No.: WO2014/146459
PCT Pub. Date: Sep. 25, 2014

(65) Prior Publication Data

US 2016/0250851 A1 Sep. 1, 2016

(30) Foreign Application Priority Data

Mar. 20, 2013 (CN) ..... 2013 1 0090759

(51) Int. Cl.
*B41J 2/145* (2006.01)
*B41J 2/16* (2006.01)
(Continued)

(52) U.S. Cl.
CPC ..... *B41J 2/145* (2013.01); *B05B 15/68* (2018.02); *B41J 2/16* (2013.01); *B41J 25/001* (2013.01)

(58) Field of Classification Search
CPC ..... B41J 2/14024; B41J 2/135; B41J 2/145; B41J 2/16; B41J 25/001; B05B 15/68
See application file for complete search history.

(56) References Cited

U.S. PATENT DOCUMENTS 6,460,778 B1 10/2002 Silverbrook
2005/0206678 A1 9/2005 Nishino
(Continued)

FOREIGN PATENT DOCUMENTS

CN 101054021 A 10/2007
CN 201020924 Y 2/2008
(Continued)

OTHER PUBLICATIONS

CN201310090759.9—Office Action—dated May 27, 2015.
(Continued)

*Primary Examiner* — Carl Arbes
(74) *Attorney, Agent, or Firm* — Brinks Gilson & Lione

(57) ABSTRACT

The present invention provides a nozzle seamless splice mechanism and an adjustment method for the same, and belongs to a field of printing machinery technology. The nozzle seamless splice mechanism and the adjustment method for the same may solve the problems of nozzles orifices stagger, reduced printing width or blankness exposed in the middle caused by the causes such as the fabrication error, the personal error, etc with respect to the existing nozzles. The nozzle seamless splice mechanism of the present invention comprises: splice mechanism comprising: a micro-device for detecting coordinates of orifices of nozzles; a nozzle adjustment base for fixing nozzles; a
(Continued)

nozzle bottom plate connected with said nozzle adjustment base adjustably. The nozzle seamless splice mechanism of the present invention has a low cost, high adjustment efficiency, and achieves digitized adjustment.

5 Claims, 5 Drawing Sheets

(51) Int. Cl.
*B41J 25/00* (2006.01)
*B05B 15/68* (2018.01)

(56) References Cited

U.S. PATENT DOCUMENTS

| | | | |
|---|---|---|---|
| 2010/0026759 | A1 | 2/2010 | Kobayashi et al. |
| 2012/0044296 | A1 | 2/2012 | Gouch et al. |

FOREIGN PATENT DOCUMENTS

| | | | | |
|---|---|---|---|---|
| CN | 101164785 | A | | 4/2008 |
| CN | 101863165 | A | | 10/2010 |
| CN | 101905567 | A | | 12/2010 |
| CN | 202021925 | U | | 11/2011 |
| CN | 202378421 | U | | 8/2012 |
| CN | 202669187 | U | | 1/2013 |
| CN | 202716554 | U | | 2/2013 |
| CN | 101863165 | A | | 10/2016 |
| DE | 202012001234 | U1 | | 5/2012 |
| EP | 2353868 | A1 | | 8/2011 |
| GB | 2483473 | A | | 3/2012 |
| JP | 2004160875 | A | | 6/2004 |
| JP | 2004345281 | A | | 12/2004 |
| JP | 2005-297554 | | | 10/2005 |
| JP | 2007-245658 | | | 9/2007 |
| JP | 4003225 | B2 | * | 11/2007 |
| JP | 2009-023292 | | | 2/2009 |
| JP | 2011240248 | A | | 12/2011 |
| JP | 202378421 | U | * | 8/2012 |

OTHER PUBLICATIONS

JP 2016-503519—Office Action—dated Oct. 18, 2016.
Extended European Search Report for EP13878677.7, dated Sep. 27, 2016

* cited by examiner nozzle splice test report unit serial number : 0, reference line angle: 0.000000

| | coordinate values of the beginning orifice | | coordinate values of the ending orifice | | relative angle | nozzle length | nozzle gap | DPI | |
|---|---|---|---|---|---|---|---|---|---|
| nozzle 0 | 481310 | -74203 | 409758 | -74213 | -0.000140 | 71552 | | 71.2, | 70.0 |
| nozzle 1 | 410741 | -125244 | 339201 | -125234 | 0.000140 | 71540 | -5 | 69.8, | 71.3 |
| nozzle 2 | 340203 | -74487 | 268653 | -74505 | -0.000252 | 71550 | +14 | 71.7, | 69.4 |
| nozzle 3 | 269640 | -125391 | 198086 | -125403 | -0.000168 | 71554 | -1 | 71.3, | 69.8 |
| nozzle 4 | 199060 | -74419 | 127497 | -74421 | -0.000028 | 71563 | -14 | 70.6, | 70.5 |
| nozzle 5 | 128474 | -125005 | 56919 | -125006 | -0.000014 | 71555 | -11 | 70.6, | 70.6 |

Fig. 8

MECHANISM FOR SEAMLESSLY SPLICING NOZZLES

CROSS-REFERENCE TO RELATED APPLICATIONS

The present application is a § 371 national stage application of PCT International Application No. PCT/CN2013/088484, filed Dec. 4, 2013, which application claims a right of priority to Chinese Patent Application No. 201310090759.9, filed Mar. 20, 2013, both of which are incorporated herein by reference in their entirety.

TECHNICAL FIELD

The present invention relates to a field of printing machinery technology, and more specifically, to a mechanism for seamlessly splicing nozzles and a method for adjusting the same.

BACKGROUND

In the field of digital ink jetprinting, when printing, ink is sprayed onto a piece of printing material through orifices of nozzles by using a voltage. According to difference in printing width, it is necessary to splice and arrange nozzles before printing such that a specimen page of specific printing width can be printed according to required printing width. For a monochromatic module, nozzles are superimposed and spliced in a transverse direction to achieve zero nozzle loss so as to fully utilize orifices of nozzles to achieve printing. For chromatography between color modules, the splicing also plays a critical role. It makes angles formed by dot arrays printed onto the printing material from orifices consistent such that it well ensures that a precondition for printing chromatography is provided.

As nozzles being spliced, they are generally arranged in two staggered rows, the number of nozzles may be adjusted according to difference in printing width. Printing width of each nozzle is also different depending on its model. That is, the number of orifices of each nozzle is also adjustable.

When nozzles are spliced, it is necessary to ensure that the beginning orifice and the ending orifice of a staggered nozzle located in the middle entirely coincide with the ending orifice and the beginning orifice of an adjacent nozzle in a splice direction, respectively.

In the present case, when nozzles are arranged, the theoretical splice positions may be defined according to the design. However, in the practical case, since there is a fabrication error in fabrication of all parts, there is an installation error in installation, and the nozzles' own sizes are different, a displacement phenomena will occur when nozzles are arranged. Once displacement occurs to nozzles, the printing width will be reduced, or there is blankness in the middle when printing, which affects the printing.

SUMMARY

An object of the present invention is to solve the problems of nozzles orifices displacement, reduced printing width or blankness exposed in the middle caused by the reasons such as the fabrication error, the personal error, etc with respect to the existing nozzles, and to provide a mechanism for seamlessly splicing nozzles.

The technical solution adopted to solve the technical problems of the present invention is a mechanism for seamless splicing nozzles, comprising:

a micro-device for detecting coordinates of orifices of the nozzles;

a nozzle adjustment base for fixing the nozzles; and a nozzle bottom plate adjustably connected with said nozzle adjustment base.

Preferably, said nozzle adjustment base is movable on the nozzle bottom plate in an arrangement direction of said orifices of the nozzles.

Preferably, said nozzle adjustment base is rotatable on the nozzle bottom plate.

Preferably, said nozzle adjustment base is connected with the nozzle bottom plate by a pin screw, said nozzle adjustment base is provided with a long hole through which the pin screw extends, the diameter of said long hole matches the diameter of the pin screw, the direction of said long hole is the same as the arrangement direction of the orifices of the nozzles.

Preferably, said long hole is provided in a middle position on the nozzle adjustment base in the arrangement direction of the orifices of the nozzles.

Preferably, said nozzle bottom plate is provided with a micrometer head for the transverse adjustment and a micrometer head for the longitudinal adjustment of the nozzle adjustment base.

Preferably, said micrometer head for the transverse adjustment is arranged on a transverse fixation base, said transverse fixation base is arranged on the nozzle bottom plate; and said micrometer head for the longitudinal adjustment is arranged on an angle adjustment base, said angle adjustment base is arranged on the nozzle bottom plate.

Preferably, the adjustment accuracy of said micrometer head is 0.01 mm.

Another object of the present invention is to provide a method for using the above mentioned mechanism for seamlessly splicing nozzles, comprising:

1) taking a nozzle located on a side of a splice platform as a reference nozzle, placing it under a micro-device, detecting coordinate values A0($x_{01}$, $y_{01}$) and B0($x_{02}$, $y_{02}$) of a beginning orifice A0 and an ending orifice B0;

wherein at this time, the angle between the line connecting the beginning orifice A0 and the ending orifice B0 and the transverse axis (x) is $\theta_0$, and $\theta_0$ is calculated according to equation $\tan\theta_0=(y_{02}-y_{01})/(x_{02}-x_{01})$;

2) placing a nozzle to be adjusted under the micro-device, detecting coordinate values A1($x_{11}$, $y_{11}$) and B1($x_{12}$, $y_{12}$) of a beginning orifice A1 and an ending orifice B1, wherein at this time, the angle between the line connecting the beginning orifice A1 and the ending orifice B1 and the transverse axis (x) is $\theta_1$, and $\theta_1$ is calculated according to equation $\tan\theta_1=(y_{12}-y_{11})/(x_{12}-x_{11})$;

3) letting $\theta_{1\text{-}0}=\theta_1-\theta_0$, calculating the value of the angle $\theta_{1\text{-}0}$ between the nozzle to be adjusted and the reference nozzle, wherein the transverse adjustment amount of the nozzle to be adjusted is $\Delta x=x_{11}-x_{02}$;

the longitudinal adjustment amount of the nozzle to be adjusted is $\Delta y=L\times\sin(\theta_{1\text{-}0})$, where L is the distance from the beginning orifice A1 to the center of the pin screw in the transverse direction, and the transverse adjustment and the longitudinal adjustment are performed; and 4) for next nozzle to be adjusted, repeat steps 2)-3).

In one embodiment according to the present invention, it is also possible to treat a nozzle which has been subjected to the adjustment as the reference nozzle. Preferably, said nozzle which has been subjected to the adjustment is adjacent to the next nozzle to be adjusted.

The advantages of the present invention are as follows:

the mechanism for seamlessly splicing nozzles of the present invention is magnified under a microscope. The microscope recognizes the coordinates of each nozzle such that it finds the coordinates of each nozzle. The seamless splice mechanism inputs the value of the needed adjustment manually in a digitized way based on the adjustability of its own structure, the computability of the coordinates, such that the adjustment is quantified, thereby achieving the seamless splice in a real sense.

In addition, the seamless splice mechanism of the present invention has a low cost (a total cost of about ¥3000 RMB) which is far lower than the price of the splice platform available on the market (for example, the price of the seamless splice platform produced by the Panasonic Corporation is ¥300,000 RMB or so).

In addition, the time taken to complete the adjustment of the same number of nozzles by the seamless splice mechanism of the present invention is ⅙ of that of the prior mechanism for seamlessly splicing nozzles, thereby improving the efficiency of the splice adjustment.

BRIEF DESCRIPTION OF THE DRAWINGS

FIG. 8 is a nozzle splicing test report for a mechanism for seamlessly splicing nozzles of the present invention.

Wherein:

1. nozzle; 2. nozzle adjustment base; 3. nozzle bottom plate; 4. transverse adjustment block; 5. angle adjustment base; 6. shaft pin adjustment screw; 7. transverse fixation base; 8. micrometer head; 9. long hole

DETAILED DESCRIPTION

In order to enable those skilled in the art to better understand the technical solutions of the present invention, hereinafter, further detailed description of the present invention is given in conjunction with the drawings and specific embodiments Embodiment 1

As shown in FIGS. 1-5, the present embodiment provides a mechanism for seamlessly splicing nozzles.

Taking an xaar1001 nozzle as an example, the present embodiment makes introduction. For nozzles of other models, the mechanism for seamlessly splicing nozzles of the present invention is only required to match that type of nozzle.

The xaar1001 nozzle has 1#-1001# orifices in total, the printing width of the orifices is 70.5 mm.

Figure 1:
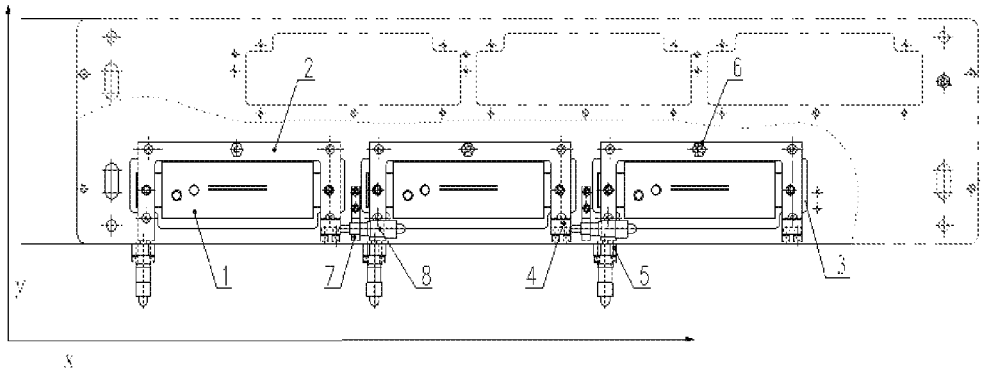
FIG. 1 is a top view of a mechanism for seamlessly splicing nozzles in an embodiment 1 of the present invention.

As shown in FIG. 1, the mechanism for seamlessly splicing nozzles includes: 6 nozzles 1 arranged in two staggering rows in a transverse direction (x axis direction). At this time, the orifices of each nozzle being also arranged in the transverse direction (x axis direction). A direction perpendicular to the above mentioned transverse direction is defined as a longitudinal direction (y axis direction);

a micro-device (not shown in the figure) for detecting coordinates of orifices of the nozzles, the micro-device including a microscope, the microscope having a coordinate system within its micro field of view (this coordinate system having the same directions as those of the above mentioned x axis direction and y axis direction) and being able to detect coordinates of orifices of the nozzles within this coordinate system;

a nozzle adjustment base 2 for fixing nozzles 1, the nozzles 1 being fixed on the nozzle adjustment base 2 by screw connection;

a nozzle bottom plate 3 adjustably connected with the nozzle adjustment base 2.

Figure 2:
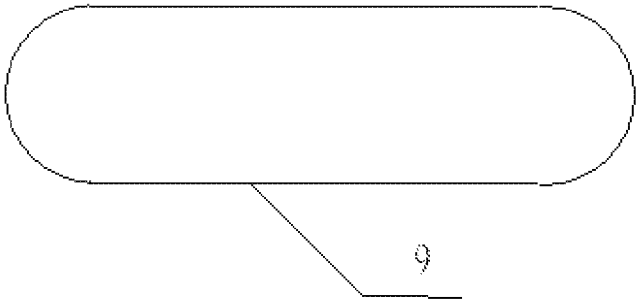
FIG. 2 is a top view of a long hole of a mechanism for seamlessly splicing nozzles in an embodiment 1 of the present invention.

Preferably, the nozzle adjustment base 2 is connected with the nozzle bottom plate 3 by a pin screw 6. As shown in FIG. 2, the nozzle adjustment base 2 is provided with a long hole 9 through which the pin screw 6 extends.

Preferably, the diameter of the long hole 9 matches the diameter of the pin screw 6, the direction of the long hole 9 is the same as the arrangement direction of orifices of the nozzles. When transverse adjustment is performed on the nozzles, the nozzle adjustment base 2 moves transversely with respect to the nozzle bottom plate 3, the pin screw moves in the length direction of the above mentioned long hole 9, which ensures that the nozzle adjustment base 2 is connected with the nozzle bottom plate 3; when longitudinal adjustment is performed on the nozzles 1, the nozzle adjustment base 2 may rotate with respect to the nozzle bottom plate 3, the pin screw is only required to rotate to ensure that the nozzle adjustment base 2 is connected with the nozzle bottom plate 3. Preferably, the shaft pin is φ3h6, the long hole 9 is 3H7, they fit each other, which may ensure the relative movement in the transverse direction and the relative rotation in the longitudinal direction of the nozzle adjustment base 2 and the nozzle bottom plate 3.

Figure 3:
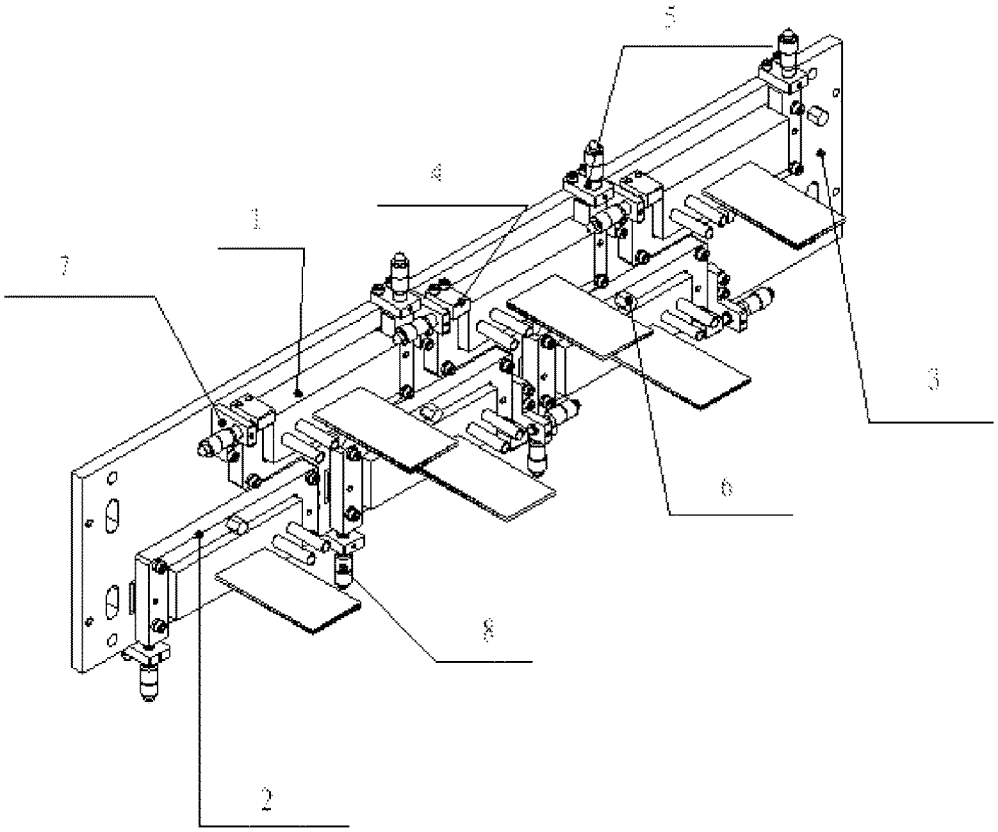
FIG. 3 is a perspective view of a mechanism for seamlessly splicing nozzles in an embodiment 1 of the present invention.

As shown in FIG. 3, in order to quantify the adjustment amount of the nozzles in the transverse direction and the longitudinal direction, the nozzle bottom plate 3 is provided with a transverse micrometer head 8 and a longitudinal micrometer head 8.

Figure 4:
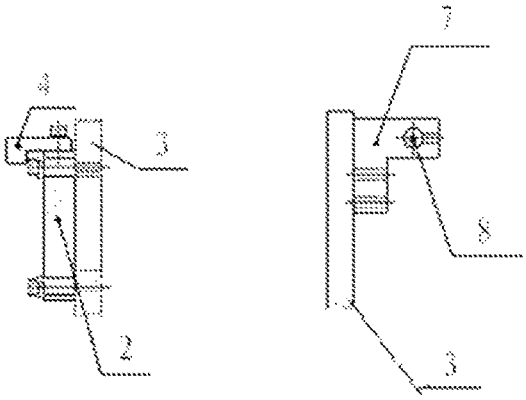
FIG. 4 is a structural diagram of a micrometer head for transverse adjustment of nozzles in a mechanism for seamlessly splicing nozzles in an embodiment 1 of the present invention.

Preferably, as shown in FIG. 4, the micrometer head 8 for adjusting the transverse position is fixed on a transverse fixation base 7, the transverse fixation base 7 is fixed on the nozzle bottom plate 3.

If the height of the transverse fixation base 7 is not enough, a transverse adjustment block 4 may be connected on the nozzle adjustment base 2, and the transverse adjustment of the nozzle is performed by moving the nozzle adjustment base 2 to the shaft head of the micrometer head 8 for adjusting the transverse position. Preferably, the minimal scale of the micrometer head 8 is 0.01 mm.

Figure 5:
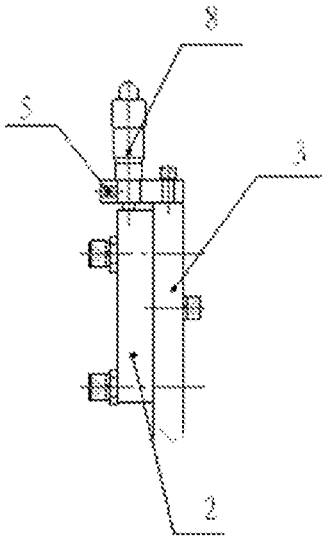
FIG. 5 is a structural diagram of a micrometer head for angle adjustment of nozzles in a mechanism for seamlessly splicing nozzles in an embodiment 1 of the present invention.

Preferably, as shown in FIG. 5, the micrometer head 8 for adjusting the angle is fixed on an angle adjustment base 5, the angle adjustment base 5 is fixed on the nozzle bottom plate 3, and the longitudinal adjustment of the nozzle is performed by moving the nozzle adjustment base 2 to the shaft head of the micrometer head 8 for adjusting the longitudinal position. Preferably, the minimal scale of the micrometer head 8 is 0.01 mm.

Figure 6:
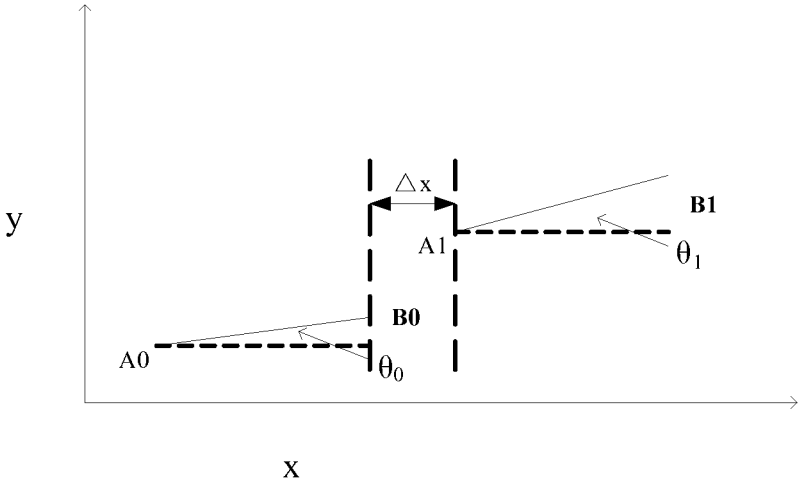
FIG. 6 is a computation diagram of a transverse adjustment amount of nozzles in a mechanism for seamlessly splicing nozzles in an embodiment 1 of the present invention.
Figure 7:
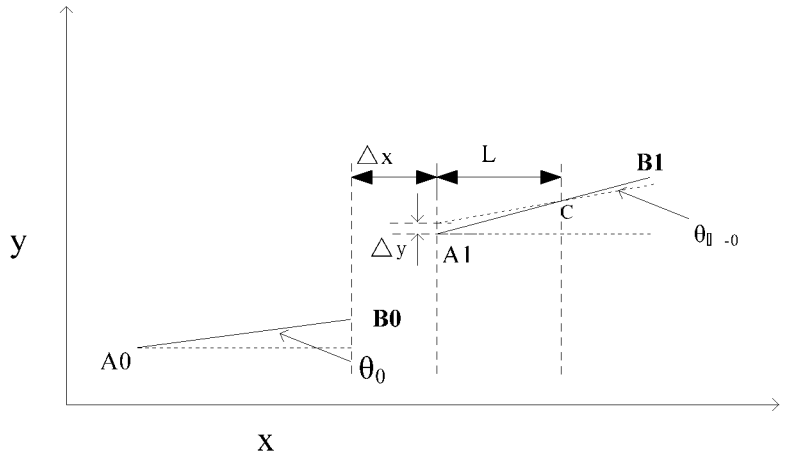
FIG. 7 is a computation diagram of a longitudinal adjustment amount of nozzles in a mechanism for seamlessly splicing nozzles in an embodiment 1 of the present invention.

Specifically, taking the above mentioned mechanism for seamlessly splicing nozzles being used to splice the xaar1001 nozzles as an example, the adjustment method thereof is introduced. The adjustment method includes:

1) take a nozzle located on a side of the splice platform as a reference nozzle. Preferably, as shown in FIG. 1, take the leftmost nozzle as the reference nozzle, place it under a micro-device, detect coordinate values A0($x_{01}$, $y_{01}$) and B0($x_{02}$, $y_{02}$) of a beginning orifice A0 and an ending orifice B0;

at this time, as shown in FIG. 6, the angle between the line connecting the beginning orifice A0 and the ending orifice B0 and the transverse axis (x) is $\theta_0$. Since $\tan\theta_0=(y_{02}-y_{01})/(x_{02}-x_{01})$, it is possible to calculate $\theta_0$;

2) place a nozzle to be adjusted (an adjacent displaced nozzle) under the micro-device, detect coordinate values A1($x_{11}$, $y_{11}$) and B1($x_{12}$, $y_{12}$) of a beginning orifice A1 and an ending orifice B1;

at this time, as shown in FIG. 6, the angle between the line connecting the beginning end orifice A1 and the ending orifice B1 and the transverse axis (x) is $\theta_1$, according to $\tan\theta_1=(y_{12}-y_{11})/(x_{12}-x_{11})$, it is possible to calculate $\theta_1$;

3) let $\theta_{1\text{-}0}=\theta_1-\theta_0$, calculate the value of the angle $\theta_{1\text{-}0}$ between the nozzle to be adjusted and the reference nozzle, as shown in FIG. 6, the transverse adjustment amount of the nozzle to be adjusted (taking A1 as a moving point) is $\Delta x=x_{11}-x_{02}$;

as shown in FIG. 7, the distance from A1 to the center (C point) of the pin screw 6 in the transverse direction is L, the line connecting A1 and B1 rotates with the pin screw 6 as a center, the longitudinal adjustment amount of the nozzle to be adjusted is $\Delta y=L\times\sin(\theta_{1\text{-}0})$, where $L=0.5\times L(A0B0)\times\cos\theta_0$; in the equation, L(A0B0) is the length of the orifice of the nozzle which is a constant value set by the manufacturer of the nozzle;

after the above mentioned transverse adjustment amount $\Delta x$ and longitudinal adjustment amount $\Delta y$ are quantified with a transverse micrometer head and a longitudinal micrometer head, adjust the transverse adjustment amount $\Delta x$ and the longitudinal adjustment amount $\Delta y$ of the nozzle adjustment base. In this way, the adjustment of the nozzle to be adjusted may be completed such that the coordinates of the orifices B0 and A1 of the two nozzles are the same in the x axis direction and the lines connecting the orifices (A0B0 and A1B1) are parallel to each other.

Preferably, the adjustment amount of the micrometer head 8 for the transverse position is set to the transverse adjustment amount $\Delta x$, the nozzle adjustment base (2) is moved to the shaft head of the micrometer head 8 for adjusting the transverse position to complete the transverse adjustment.

The reading of the micrometer head 8 for adjusting the angle is set to $\Delta y$, the nozzle adjustment base is rotated to the shaft head of the adjusted micrometer head 8, the shaft pin adjustment screw 6 is screwed tightly, the screw of the nozzle adjustment base 2 is fixed to complete the transverse adjustment and the longitudinal adjustment of the nozzles such that the seamless splice is completed.

4) for the next nozzle to be adjusted, repeat steps 2-3.

Finally, adjustment of all nozzles is completed to achieve the seamless splice of the nozzles.

The result of applying the above mentioned method to the xaar1001 nozzles for seamless splicing is shown in FIG. 8. As shown in FIG. 8, taking the 0# nozzle as a reference (unit: micron), the gap between respective nozzles has a maximum value of 0.014 mm and a minimum value of 0.001 mm (at this time, they almost coincide). According to the resolution 360 dpi of the xaar1001 nozzles, one line=25.4/360=0.0705 mm, even for 720 dpi, one line=25.4/720=0.035 mm. The splice accuracy has a maximum of 40% of one line of 720 dpi (high resolution) (0.014 mm/0.035 mm), whereas the high quality nesting line accuracy of high resolution (720 dpi) is half line, i.e. 0.0175 mm.

Likewise, the angle error has a maximum value of 0.000252°, the transverse error=$L\times\sin\theta\approx L\times\theta$=35.2 mm×0.000252°×π/180≈0.155 micron, that value may be omitted approximately.

As seen from the above test result, this mechanism well achieves the object of the seamless splice of the nozzles, and this mechanism has a low cost (a total cost of about ¥3000 RMB) which is far lower than the price of the splice platform on the market (for example, the production price of the Panasonic Corporation is ¥300,000 RMB or so).

Meanwhile, the time taken to complete the adjustment of the same number of nozzles is ⅙ of that of the prior mechanism for seamlessly splicing nozzles, thereby improving the efficiency of the splice adjustment.

The mechanism for seamlessly splicing nozzles of the present embodiment is magnified under a microscope, the microscope identifies the coordinates of each nozzle such that it finds the coordinates of each nozzle. The seamless splice mechanism inputs the value of the needed adjustment manually in a digitized way by the adjustability of its own structure, the computability of the coordinate, such that the adjustment is quantified, thereby achieving the seamless splice in a real sense.

In the above mentioned embodiment, the reference nozzle may always adopt the nozzle located in a side of the splice platform, a nozzle that has been subjected to the adjustment may also be adopted as a new reference nozzle. For example, in another embodiment according to the present invention, a nozzle which is adjacent to the next nozzle to be adjusted and which has been subjected to the adjustment is adopted as a new reference nozzle.

It may be understood that the above embodiments are merely exemplary embodiments adopted to illustrate the principle of the present invention, however, the present invention is not limited thereto. To those skilled in the art, without departing from the spirit and essence of the invention, various modifications and improvements may be made, these modifications and improvements are also considered to be within the protection scope of the present invention.

What is claimed is:

1. A mechanism for seamless splicing nozzles, comprising:

a microscope for detecting coordinates of orifices of the nozzles within a field of view of the microscope;

a nozzle adjustment base for fixing the nozzles;

a nozzle bottom plate adjustably connected with said nozzle adjustment base;

wherein said nozzle adjustment base is connected with the nozzle bottom plate by a pin screw, said nozzle adjustment base is provided with a long hole through which the pin screw extends, the diameter of said long hole matches the diameter of the pin screw, the direction of said long hole is the same as the arrangement direction of the orifices of the nozzles, said nozzle adjustment base is movable on the nozzle bottom plate in an arrangement direction of said orifices of the nozzles by moving said pin screw in the direction of said long hole, such that a transverse adjustment is performed on said nozzle, and said nozzle adjustment base is rotatable on the nozzle bottom plate with said pin screw as a rotating center, such that a longitudinal adjustment is performed on said nozzle.

2. The mechanism according to claim 1, wherein said long hole is provided in a middle position on the nozzle adjustment base in the arrangement direction of the orifices of the nozzles.

3. The mechanism according to claim 1, wherein said nozzle bottom plate is provided with a micrometer head for the transverse adjustment and a micrometer head for the longitudinal adjustment of the nozzle adjustment base.

4. The mechanism according to claim 3, wherein said micrometer head for the transverse adjustment is arranged on a transverse fixation base, said transverse fixation base is arranged on the nozzle bottom plate; and said micrometer head for the longitudinal adjustment is arranged on an angle adjustment base, said angle adjustment base is arranged on the nozzle bottom plate.

5. The mechanism according to claim 4, wherein the adjustment accuracy of said micrometer head is 0.01 mm.

* * * * *